US008516730B2

(12) United States Patent
Valin

(10) Patent No.: US 8,516,730 B2
(45) Date of Patent: Aug. 27, 2013

(54) RIFLE/SHOT GUN RECOIL REDUCTION SYSTEM

(76) Inventor: Norman A. Valin, Spring Hill, FL (US)

( * ) Notice: Subject to any disclaimer, the term of this patent is extended or adjusted under 35 U.S.C. 154(b) by 0 days.

(21) Appl. No.: 13/313,200

(22) Filed: Dec. 7, 2011

(65) Prior Publication Data

US 2013/0145668 A1 Jun. 13, 2013

(51) Int. Cl.
*F41C 23/08* (2006.01)

(52) U.S. Cl.
USPC ..... 42/74

(58) Field of Classification Search
USPC ..... 42/1.06, 74; 89/14.3
See application file for complete search history.

(56) References Cited

U.S. PATENT DOCUMENTS

| | | | | | |
|---|---|---|---|---|---|
| 247,451 | A * | 9/1881 | White | 42/74 |
| 490,129 | A * | 1/1893 | Tredway et al. | 42/74 |
| 524,458 | A * | 8/1894 | Blake | 42/74 |
| 837,601 | A * | 12/1906 | Behr | 42/74 |
| 935,163 | A * | 9/1909 | Parker | 42/74 |
| 1,255,566 | A * | 2/1918 | Pearson | 42/74 |
| 1,307,529 | A * | 6/1919 | Werndl | 42/74 |
| 1,328,700 | A * | 1/1920 | Wagoner | 42/74 |
| 1,334,467 | A * | 3/1920 | Moller | 42/74 |
| 3,707,797 | A * | 1/1973 | Ruth | 42/74 |
| 4,439,943 | A * | 4/1984 | Brakhage | 42/74 |
| 4,663,877 | A * | 5/1987 | Bragg | 42/74 |
| 5,974,718 | A * | 11/1999 | Bentley et al. | 42/74 |
| 6,481,143 | B2 * | 11/2002 | McCarthy | 42/74 |
| 7,493,717 | B2 | 2/2009 | Gussalli Beretta | |
| 2008/0178508 | A1 * | 7/2008 | Cinciu | 42/1.06 |

* cited by examiner

*Primary Examiner* — Bret Hayes
(74) *Attorney, Agent, or Firm* — Allen, Dyer, Doppelt, Milbrath & Gilchrist, P.A.

(57) ABSTRACT

A rifle recoil reduction system is presented for reducing a recoil impact of a rifle. The system includes two parallel spaced-apart spring operated piston assemblies mounted between two spaced-apart plates, separated in part to work simultaneously together to provide an equal amount of pressure to the pistons. The pistons preferably have a pre-load of about 250 kg (550 pounds), and can be changed to increase or decrease the pre-load. A recoil pad is included to provide additional relief to the shooter.

4 Claims, 2 Drawing Sheets

RIFLE/SHOT GUN RECOIL REDUCTION SYSTEM

FIELD OF THE INVENTION

The invention relates to a recoil reduction system for rifles and shot guns, especially those used for hunting and sports activities.

BACKGROUND OF THE INVENTION

The recoil is a characteristic common to all firearm types, which leads to particularly significant effects in the case of longer guns. This phenomenon, a characteristic application of the action/reaction principle, indicates the impulse that causes the gun to move back due to the impulse that the gun imparts to the bullet when firing it. The shooter, and in particular the user of long guns, is often subjected to considerable impulsive forces in the rifle stock support zone or butt stock end plate. The discharge (firing) of a shoulder held firearm can generate forces of 300 kg (660 pounds) on up, which is impacted onto the shooter's shoulder. This happens through the end of the butt stock.

The object of the present invention is to provide a retro-fit or original equipment manufactured recoil reduction system to the butt stock for significantly reducing these recoil impulsive forces.

SUMMARY OF THE INVENTION

The invention is a recoil dampening system for shot guns, rifles, or any other shoulder fired firearm. As used hereinafter, the term "rifle" is generically used to be inclusive of any shoulder fired firearm, including rifles, shot guns, etc. Further, as used hereinafter, the term "butt end of a rifle stock" and the like refers to an original uncut butt end (wood or metal stock) or a stock that has been modified by cutting off a portion of the butt end, that is, the resultant new butt end of the stock.

The invention comprises the two parallel spaced-apart spring operated pistons mounted between two spaced-apart plates, separated in part to work simultaneously together to provide an equal amount of pressure to the pistons. The pistons preferably have a pre-load of 250 kg (550 pounds), and can be changed to increase or decrease the pre-load + or −50 kg. A recoil pad which is mounted to the end of the distal metal plate from the butt stock provides additional relief to the shooter and brings the impact well within the limits of the recoil.

The impact of the recoil is instant. The pistons are the first to react, the recoil pad anchors the second. The invention is based on a simple system of mounting a unit with a controlled clamping system that will contain more than 60% of the recoil to the shooter. Where a recoil pad generally provides a maximum of 15-25% reduced recoil shock absorption, the present invention together with a pad can reduce the recoil 60%-90% range.

The invention is a retro-fit for an owner of a rifle. It has two purposes, one for reducing the recoil and the other for the owner to control the length of his stock. It consists of two operations, one for cutting the butt end of the stock to mount the system and the other is the mounting itself by drilling two pilot holes in the butt end of the stock to fasten the inventive system with screws, typically two is sufficient.

DETAILED DESCRIPTION OF THE INVENTION

Figure 1:
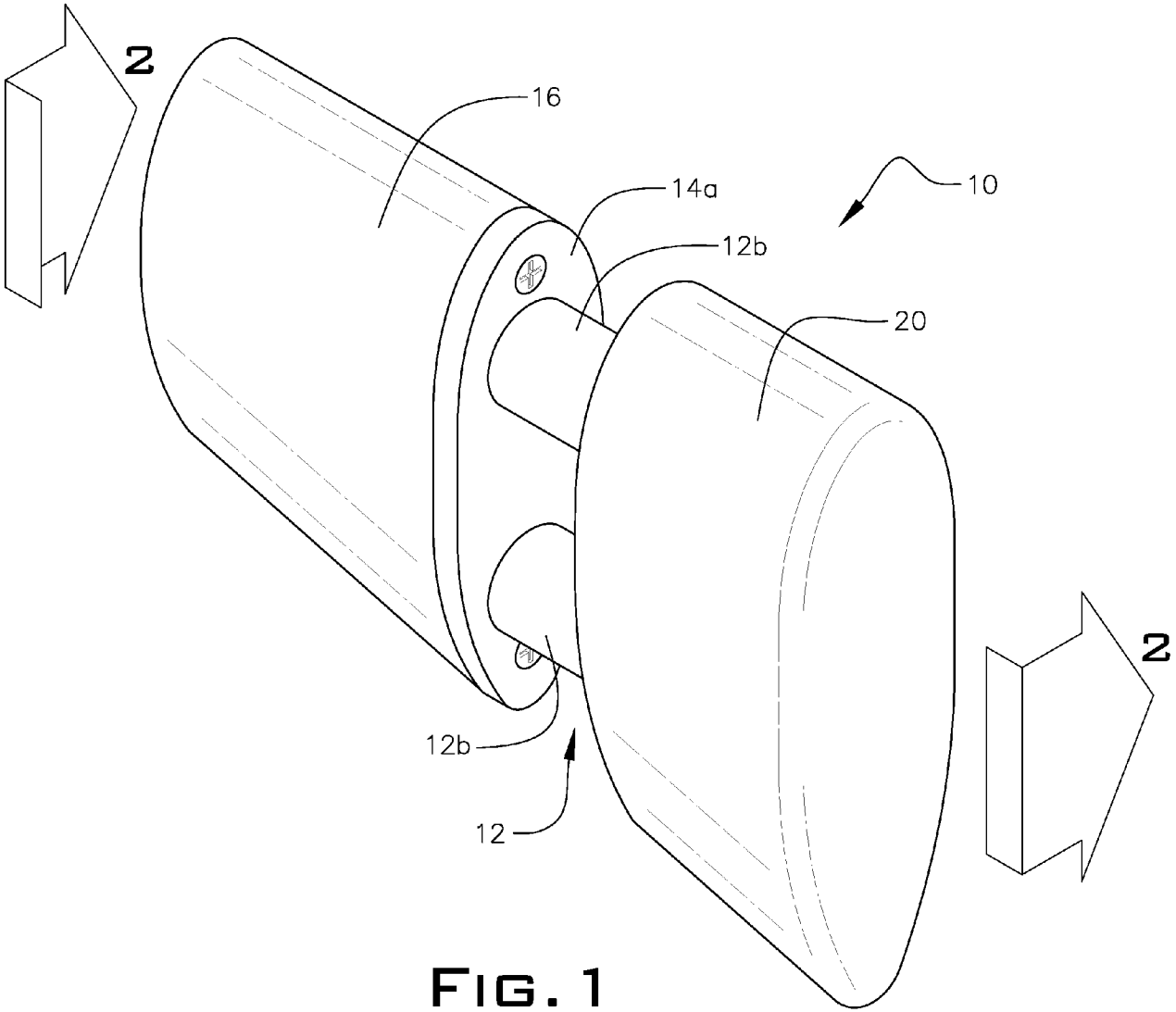
FIG. 1 is a conception depiction of the invention assembly mounted to the butt end of a rifle stock with a slip-on recoil pad that can be mounted with screws or adhesive or simply slip-on mounted over one end of the invention assembly.
Figure 2:
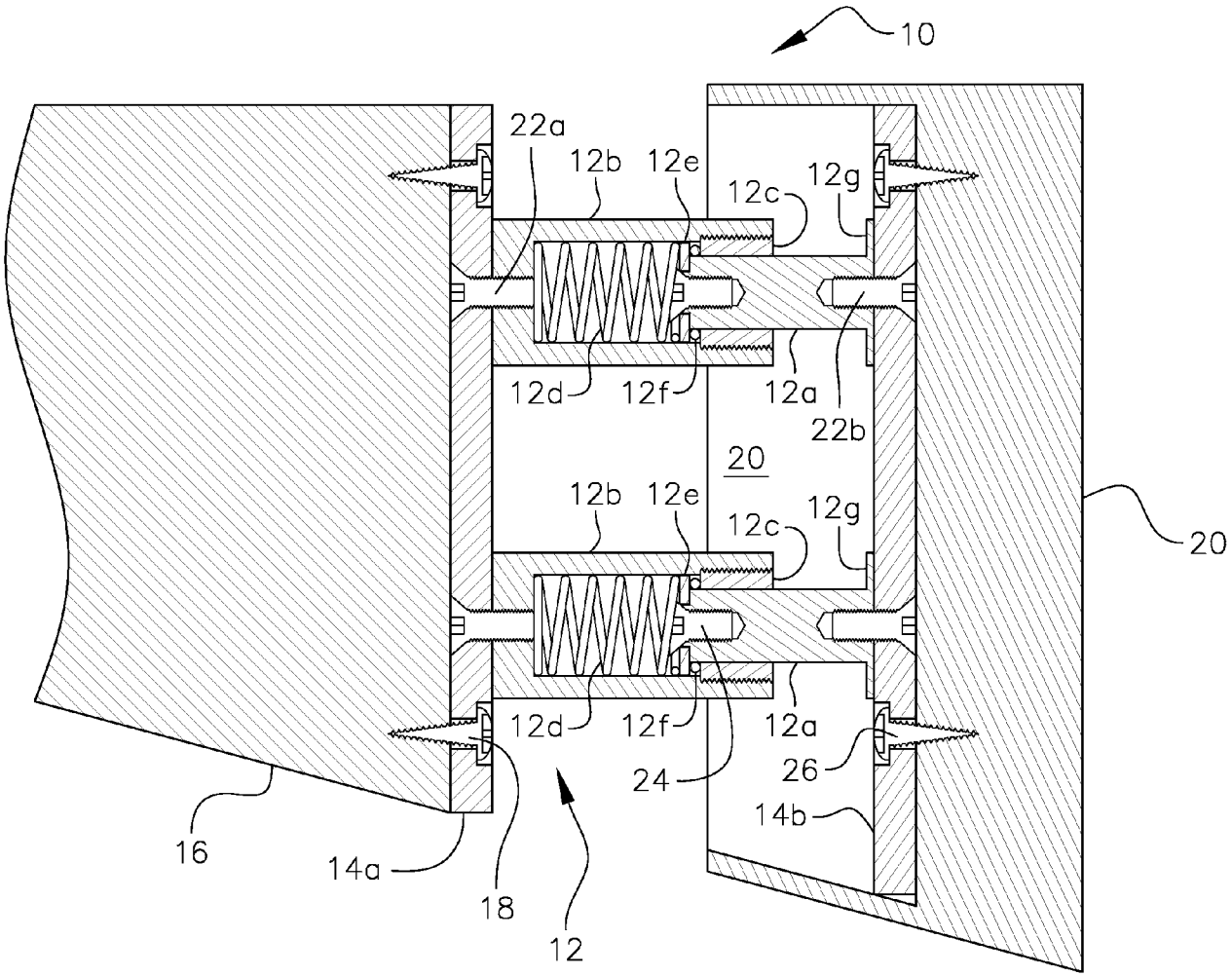
FIG. 2 is a cross-section view of the depiction of FIG. 1.

Referring now to the drawings, FIGS. 1 and 2 disclose a typical example of the present invention, which is a rifle recoil reduction system, depicted generally as 10.

The rifle recoil reduction system 10 comprises recoil damping means 12 for reducing a recoil impact of a rifle. The damping means 12 is mounted between two spaced-apart plates 14*a*,14*b*, wherein one of the plates 14*a* is configured to be attached to an outside surface of a butt end of a rifle stock 16. The attachment can be done in a number of ways known on the art but the preferred method is simply to use a couple of fasteners 18, like screws. As an example, FIG. 2 depicts fasteners 18 as being inserted into a counter-bore 3/32 inch deep×3/8 inch diameter using pan head 8×3/4 inch long screws. Damping means 12 are typically fastened to each end plate 14*a*,14*b*, as shown in FIG. 2 by way of example.

The invention further comprises recoil padding means 20 for providing additional recoil impact absorption mounted to another of the end plates (plate 14*b* shown in FIG. 2), which is distally located from the butt end of the rifle stock 16. A preferred padding means is to simply provide a slip-on pad over the distally locally plate 14*b* such as the commercially available slip-on recoil pad made by the WINCHESTER® Company. The slip-on pad 20 can be mounted with screws 26 as depicted in FIG. 2, or adhesive mounted to the plate 14*b* (not shown), or both screwed and adhesively mounted, or simply just slipped over the plate 14*b*. In the FIG. 2 depiction, as an example only, screws 26 can be sheet metal 6×3/4 inch long screws. In fact, such a pad would as depicted on FIG. 2 extend partially over part of the damping means 12 therefore serving as a shroud over the piston portion of the damping means 12 described below to protect the pistons from adverse environmental elements such as rain and dust or dirt. Nevertheless, the piston/guide arrangement depicted in the drawings could be reversed if desired by the end user.

The damping means 12 comprises a pair of parallel spaced-apart spring operated pistons 12*a* and a pair of mating piston guides 12*b*. The pistons 12*a* extend perpendicularly from one of the plates 14*b* and serving as sliding shafts configured to slide within the mating piston guides 12*b*. The mating piston guides 12*b* also serve as a housing for the respective pistons 12*a*. The pistons 12*a* can be attached to the plate 14*b* using fasteners 22*b* like cap screws and the guides 12*b* can be attached to the plate 14*a* using similar fasteners 22*a*.

A bushing 12*c* is inserted at an end of each of the mating piston guides 12*b*. The bushings 12*c* extend within the guides a predetermined distance, for example, about 7/16 inches, and the pistons 12*a* are configured to slide within an internal diameter of each bushing 12*c*. It is preferred that the bushing 12*c* be made from a material dissimilar then that of the piston 12*a* and guide 12*b*. For example, the piston 12*a* can be made from a copper base material, include alloys of nickel-copper, nickel-copper-aluminum, bronze, brass, etc., and the piston 12*a* and guide 12*b* can be made from a hard coat anodized aluminum material, stainless material and other materials dissimilar to the bushing material.

The invention further includes a spring 12*d* configured to be inserted and compressed within each of the guides 12*b*, and a flat circularly shaped metal material configured in a washer form 12*e* to interface between each piston 12*a* end and each spring 12*d*.

It is an object of the present invention is to provide a system that allows the piston to travel about 7/16 inches when discharged to spend its energy toward its limits of motion, which is controlled by what each owner expects in recoil. Every recoil system is different in nature. The present invention provides for a system that harnesses a portion of its energy, resulting in a controlled shoot.

In order to provide an additional cushioning or shock absorbing characteristic, an elastomeric cushion 12*f* or bumper is located between the washer 12*e* and an internal interface surface of the bushing 12*c*. Preferably, the elastomeric cushion is in the form of a rubber o-ring or a rubber washer that is concentric to the outside diameter of the piston 12*a*. A rubber material such as butyl-n material is suitable.

An example of approximate dimension that could be used to make the invention include the following:

The piston 12*a* can be 1 1/16 inches in length with an outside diameter of 0.439 inches. The bushing 12*c* can have a length of 7/16 inch with a threaded outside diameter suitable for threadingly engaging a threaded end of the guide 12*b* such that when screwed into the guide, the bushing 12*c* is fully inserted within the guide 12*b*. The bushing can have an outside diameter of 0.687 inches with an internal diameter of 0.440 inches. The washer 12*e* would be placed against the face of the piston 12*a* and secured with a fastener 24 into the face of the piston 12*a* as conceptually depicted in FIG. 2. A boss (not shown) may be provided at the end face of the piston 12*a* to match the internal diameter of the washer 12*e* to ensure the alignment of the washer 12*e* before securing with fastener 24. Fastener 24 can be a 10-32×3/8 flat head cap screw screwed into a 10-32 thread×1/2 inch hole. The washer 12*e* can be a 1/16×0.600 steel washer. Piston 12*a* may have a base plate 12*g* that can be optionally welded to plate 14*b* or fastened to plate 14*b*. The base plate 0.045 thick by 7/8 inch diameter comes from turning the piston out of 7/8 inch material leaving 0.045 inch. The piston 12*a* is ultimately attached to the plate 14*b* using fasteners 22*b*, typically a 10-32×3/8 flat head cap screw screwed into a 10-32 thread×1/2 inch hole.

The guides 12*b* can be made from a 7/8 inch stock material with a length of 1 11/16 inches long. It too can be attached to the plate 12*a* using fastener 22*a* similar to the 10-32 threaded cap screws described above. Bushing 12*c* would insert into an portion of the guide 12*b* that has a 7/16 inch depth and a 0.688 inside threaded diameter. The portion of the guide 12*b* that houses the spring 12*d* has a depth of 1 inch and an internal diameter of 0.607 inches.

It should be understood that the preceding is merely a description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

What is claimed is:

1. A rifle recoil reduction system comprising:

recoil damping means for reducing a recoil impact of a rifle;

said damping means being mounted between two spaced-apart plates, wherein one of said plates is configured to be attached to an outside surface of a butt end of a rifle stock;

recoil padding means for providing additional recoil impact absorption, the recoil padding means being mounted to another of the end plates which is distally located from the butt end of the rifle stock;

a pair of parallel spaced-apart spring operated pistons and a pair of mating piston guides, the pistons extending perpendicularly from one of the plates and serving as sliding shafts configured to slide within the mating piston guides, the mating piston guides serving as a housing for the respective pistons;

a bushing inserted at an end of each of the mating piston guides and extending within said guides a predetermined distance, the pistons configured to slide within an internal diameter of each bushing;

a spring configured to be inserted and compressed within each of the guides; and a flat circularly shaped metal material configured in a washer form to interface between each piston end and each spring.

2. The system according to claim 1, further comprising:

an elastomeric cushion located between the flat circularly shaped metal material and an internal interface surface of the bushing.

3. The system according to claim 2, wherein the elastomeric cushion is a rubber o-ring.

4. The system according to claim 1, wherein the bushings and pistons are made from dissimilar materials.

* * * * *